US010020573B2

(12) United States Patent
Wilbur

(10) Patent No.: US 10,020,573 B2
(45) Date of Patent: Jul. 10, 2018

(54) ANTENNA SENSOR

(71) Applicant: General Electric Company, Schenectady, NY (US)

(72) Inventor: Mark S. Wilbur, Painesville, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 15/354,551

(22) Filed: Nov. 17, 2016

(65) Prior Publication Data

US 2017/0069962 A1 Mar. 9, 2017

Related U.S. Application Data

(63) Continuation of application No. 13/667,163, filed on Nov. 2, 2012.

(51) Int. Cl.

| | |
|---|---|
| ***H01Q 1/44*** | (2006.01) |
| ***H01Q 1/22*** | (2006.01) |
| *H05B 37/02* | (2006.01) |

(52) U.S. Cl.

CPC ..... *H01Q 1/44* (2013.01); *H01Q 1/2291* (2013.01); *H05B 37/0272* (2013.01); *Y10T 29/49018* (2015.01)

(58) Field of Classification Search

CPC ..... F21V 17/06; F21V 23/06; H01R 33/94; H01R 33/9453; H05B 37/0272; H05B 39/041

See application file for complete search history.

(56) References Cited

U.S. PATENT DOCUMENTS

| | | | | |
|---|---|---|---|---|
| 5,157,659 | A | 10/1992 | Schenkel | |
| 6,340,864 | B1 | 1/2002 | Wacyk | |
| 7,812,543 | B2 | 10/2010 | Budike, Jr. | |
| 8,328,582 | B1 * | 12/2012 | Carley | H01R 33/94 439/642 |
| 2007/0109142 | A1 | 5/2007 | McCollough, Jr. | |
| 2010/0052866 | A1 | 3/2010 | Elferich et al. | |
| 2010/0121318 | A1 | 5/2010 | Hancock et al. | |

(Continued)

FOREIGN PATENT DOCUMENTS

| | | | |
|---|---|---|---|
| CN | 101742775 | A | 6/2010 |
| CN | 102353752 | A | 2/2012 |
| CN | 102573172 | A | 7/2012 |

(Continued)

OTHER PUBLICATIONS

PCT Search Report and Written Opinion issued in connection with corresponding PCT Application No. PCT/US2013/062783 dated Nov. 21, 2013.

(Continued)

*Primary Examiner* — Monica C King

(74) *Attorney, Agent, or Firm* — Peter T. DiMauro; GE Global Patent Operation

(57) ABSTRACT

An antenna sensor includes an antenna operable to receive and/or transmit radio frequency (RF) signals, and one or more sensors operably connected to the antenna and configured to monitor at least one condition and to output sensor signals. A single connection is provided for connection to an electronic device to transfer RF signals from the antenna and sensor signals from the one or more sensors to the electronic device.

11 Claims, 3 Drawing Sheets

(56) References Cited

U.S. PATENT DOCUMENTS

| | | | |
|---|---|---|---|
| 2012/0091902 | A1 | 4/2012 | Radermacher |
| 2013/0094554 | A1 | 4/2013 | Kennard |

FOREIGN PATENT DOCUMENTS

| | | | |
|---|---|---|---|
| CN | 102682543 | A | 9/2012 |
| WO | 2012059842 | A1 | 5/2012 |

OTHER PUBLICATIONS

U.S. Non-Final Office Action issued in connection with corresponding U.S. Appl. No. 13/667,163 dated Mar. 10, 2016.
Mexican Office Action issued in connection with corresponding MX Application No. MX/A/2015/005583 dated Apr. 29, 2016.
U.S. Final Office Action issued in connection with corresponding U.S. Appl. No. 13/667,163 dated Jun. 17, 2016.
Chinese Office Action issued in connection with corresponding CN Application No. 201380057505.5 dated Aug. 3, 2016.
Second Office Action and Search issued in connection with corresponding CN Application No. 201380057505.5 dated Apr. 14, 2017.

* cited by examiner

ANTENNA SENSOR

CROSS REFERENCE

This application is a continuation of commonly-owned, co-pending patent application Ser. No. 13/667163, filed 2 Nov. 2012, which is hereby incorporated by reference in its entirety.

BACKGROUND

Many different types of electronic devices utilize an antenna operably connected to a receiver and/or transmitter to receive and/or transmit radio frequency (RF) signals. In addition, many of these devices include one or more sensors that monitor environmental or circuit conditions associated with the electronic device. In some cases, it would be desirable to add one or more sensors to an existing electronic device to increase functionality, but retrofitting sensors can be expensive and complicated.

An example of an electronic device that increasingly is being designed to receive and transmit RF signals is street lamps which are employed by municipal and highway lighting systems to illuminate roadways. Such street lamps include a light source at the top of a support pole or post, and are turned ON or illuminated at a certain time every night. Some modern street lamps include light-sensitive photocells that function with internal control circuitry to turn ON the street lamps at dusk, turn OFF the street lamps at dawn, and/or activate the street lamps to turn ON in dark weather. However, older street lamp models may not include light sensors, and may instead be operable to turn ON based on an internal clock and a schedule programmed into control circuitry. Some of these older model street lamps do include control circuitry that includes an RF receiver with an antenna that is operable to receive control signals from a command center. The received signals are typically utilized by the control circuitry to perform functions such as changing the programmed schedule and/or to turn ON the street lamps and/or to turn OFF the street lamps.

Intelligent street lights are currently being manufactured that adjust light output based on usage and current conditions, and that include RF receivers and transmitters which operate via a network configuration. For example, such intelligent street lights may include one or more sensors and control circuitry that can automatically discriminate between (or classify) a pedestrian versus a cyclist versus an automobile so that the street light can adjust the light output accordingly, that can monitor conditions such as wind velocity, temperature and ambient light intensity, and that can transmit data concerning the monitored activities to a central command center, for example. Such street lights may also be configured to adjust light output levels depending on road conditions, such as the presence of snow or rain (which may provide increased light reflectance and thus a reduced light need). However, such intelligent street lights and network systems are expensive to install and operate, and the costs involved for removing conventional street lights and replacing them with intelligent street lights and associated network hardware and software can be prohibitive for many municipalities.

SUMMARY OF THE INVENTION

Disclosed are apparatus and methods for providing an antenna sensor. In an embodiment, the antenna sensor includes an antenna operable to receive and/or to transmit radio frequency (RF) signals, and one or more sensors operably connected to the antenna. The sensors are configured to monitor at least one condition and to output sensor signals. The antenna sensor includes a single connector for connection to an electronic device, to transfer RF signals from the antenna and sensor signals from the one or more sensors to the electronic device.

A lamp is also disclosed that includes a housing, a light source supported within the housing, driver circuitry within the housing that includes a radio frequency (RF) input connector, and an antenna sensor operably connected to the driver circuitry. The driver circuitry is operably connected to the light source, and is configured for controlling the light source. The antenna sensor includes an antenna operable to at least one of receive and transmit RF signals, and at least one sensor operably connected to the antenna and configured to monitor at least one condition and to output sensor signals. A single connection to the RF input connector transfers the RF signals from the antenna and the sensor signals from the at least one sensor to the driver circuitry.

DETAILED DESCRIPTION

Figure 1:
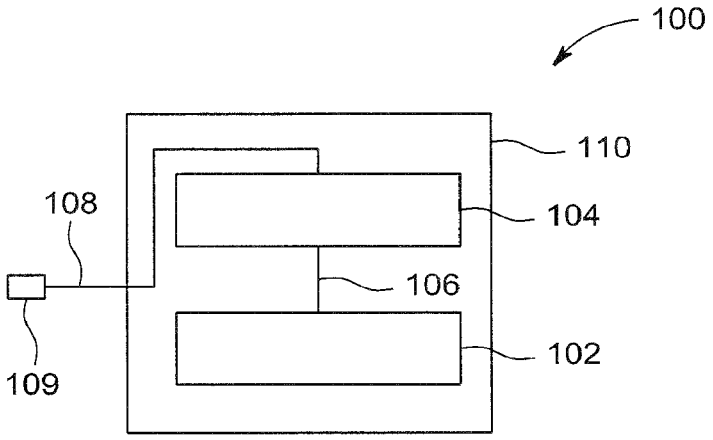
FIG. 1 is a schematic block diagram of a sensor antenna arrangement according to an embodiment of the invention.

FIG. 1 is a schematic block diagram of a sensor antenna arrangement 100 according to an embodiment. The sensor antenna 100 includes an antenna 102 for receiving radio frequency (RF) signals and a sensor 104. In the embodiment of FIG. 1, the antenna is operably connected to the sensor 104 via a coaxial cable 106. In addition, an output of the sensor 104 may be provided via a coaxial cable 108 that may include a sub-miniature version A connector (an SMA connector) 109. SMA connectors are coaxial RF connectors that are utilized for connecting two portions of a coaxial cable. The SMA connector 109 may be connectible to, for example, the input of a driver circuit of an electronic device (not shown). A housing 110 may be provided to house and to protect the antenna 102 and sensor 104.

It should be understood that the sensor 104 may include one or more sensors that function to obtain and/or to provide one or more types of information which may relate to the operation or the environment of the electronic device. Examples of such sensors include, but are not limited to, photodetectors, motion sensors, temperature sensors, wind speed sensors and audio sensors. Such sensors may be utilized alone or in any combination. In addition, it should be understood that the sensor antenna arrangement 100 may be utilized with any number of electronic devices that utilize RF communications during operation. For example, the sensor antenna arrangement 100 may be integrated with, or may be configured to retrofit to, a tracking device (such as a GPS device), a street lamp that may also include circuitry for operating the lamp, an auditory assistant device, a biomedical telemetry device, a cable input selector switch device, a citizens band (CB) device, and/or to automobile controller circuitry.

Figure 2:
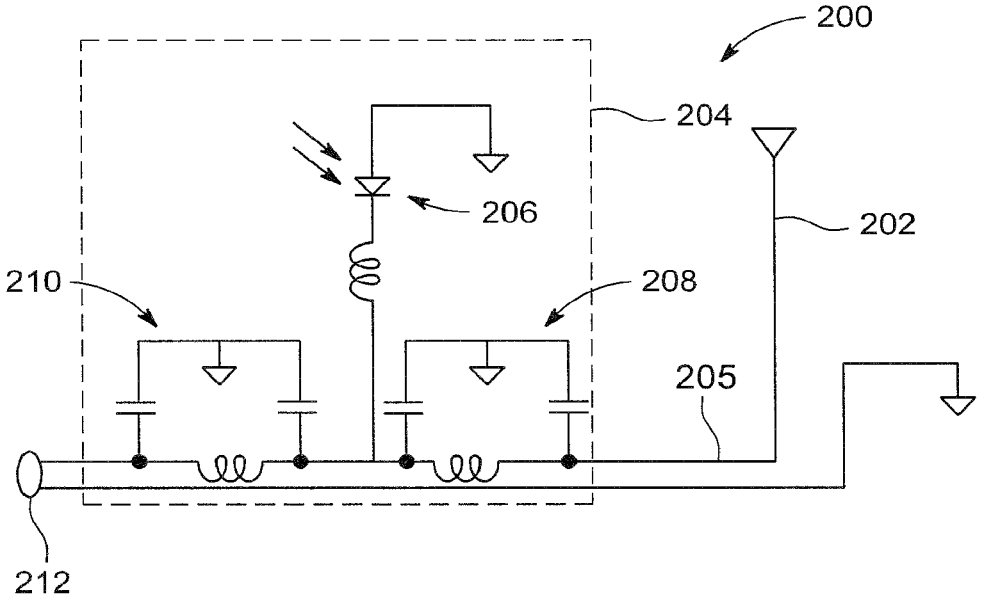
FIG. 2 is a circuit diagram of a sensor antenna arrangement which includes an antenna and a photodetector according to an embodiment of the invention.

FIG. 2 is a circuit diagram of a sensor antenna arrangement 200 according to an embodiment which includes an antenna 202 and a photodetector represented by dotted line 204. The sensor antenna arrangement 200 is similar to the sensor antenna arrangement 100 of FIG. 1, and includes an antenna 202 operably connected via coaxial cable 205 to the photodetector sensor circuitry 204. The photodetector sensor 204 includes a photodiode 206 for detecting incident light that is connected between an output tuning circuit 208 and an input tuning circuit 210. In some embodiments, the input tuning circuit 210 includes an SMA connector 212 for input to an electronic device (not shown) that utilizes RF communications during operation. Thus, an RF signal input (from the antenna 202) and a sensor input signal (an analog signal from the sensor 206) are both output on a single RF coaxial cable for input, for example to smart driver circuitry (which will be discussed below).

Figure 3:
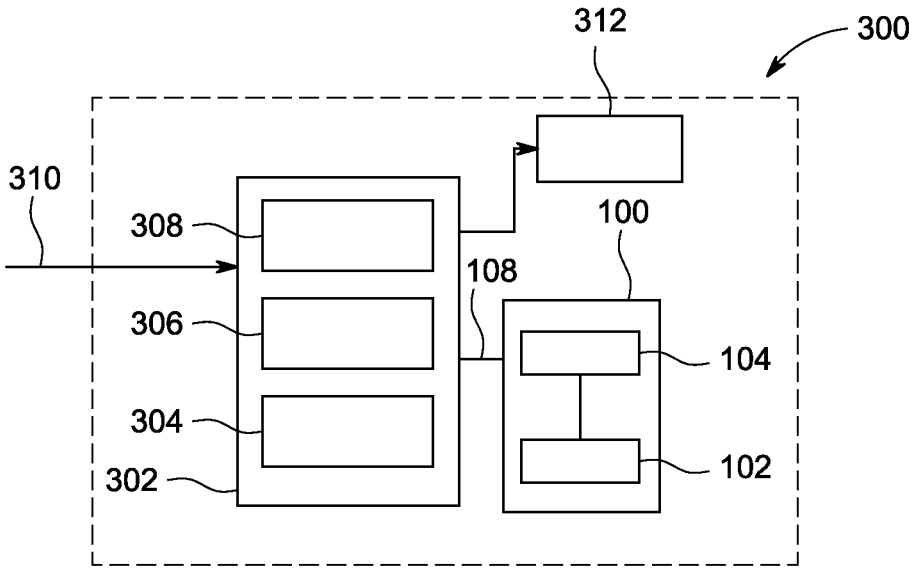
FIG. 3 is a schematic block diagram of a lamp assembly that includes the sensor antenna arrangement of FIG. 1.

FIG. 3 is a schematic block diagram of a lamp assembly 300 that includes the sensor antenna arrangement 100 of FIG. 1. In particular, the lamp assembly 300 includes components that function to control a light source, such as a street lamp. The sensor antenna arrangement 100 includes an antenna 102 and sensor 104, and is operably connected to a smart driver 302. The smart driver 302 includes a controller 304, a RF receiver 306 and a power supply 308, and is operably connected to an alternating current (AC) main power supply 310. The smart driver 302 is also operably connected to a light source or lamp 312 which may include a plurality of light emitting diodes (LEDs). In some implementations, the antenna 102 may be operable to receive control signals transmitted from, for example, a lighting command center (not shown) that may be operated by a municipality and the like. Such a lighting command center may transmit RF communication signals which are received by the antenna 102 and fed to the RF receiver 306 via the coaxial cable 108 for interpretation and/or use by the controller 304. In addition, sensor signals from the sensor 104 are fed to the smart driver 302 via the same coaxial cable 108 for interpretation and or use by the controller. Thus, the controller is configured for receiving both RF communication signals from the antenna 104 and sensor signals from the sensor 102, and thus is also configured for separating and distinguishing between the RF communication signals and the sensor signals. For example, the controller may operate to de-multiplex the RF signals from the antenna and the analog signals from the sensor (for example, by utilizing an asynchronous time division (ATD) multiplexing protocol) to isolate the signals and then function to match the separated signals to specific operations in order to control the lamp 312. Thus, the smart driver 302 is capable of receiving, separating and distinguishing between multiple communication and control signals to control the functions of the lamp 312.

In the embodiment of FIG. 3, the lamp 312 may consist of a plurality of light emitting diodes (not shown) that may be configured to collectively produce white light. LEDs are increasingly being adopted for a wide variety of lighting tasks due to their long life, low power requirements, and low heat generation. Thus, many communities have already installed such LED lamps in their street lights to obtain the benefits of LED-based systems. The lamp 312 may be controlled by the controller 304 to operate in accordance with a schedule (for example, via use of an internal clock set to the time when dusk occurs to turn ON the lamp, and set to the time when dawn occurs to turn OFF the lamp), and may also dictate the power levels applied to the lamp. The controller 304 may function to, for example, change the lighting schedule of the lamp, or illuminate the lamp, or extinguish the lamp in response to communication signals received by the antenna 102, or in response to sensor signals from the sensor 104. For example, a control signal to turn ON the lamp may be transmitted from a central control station when stormy weather occurs during the daytime hours, or the sensor may be a photosensor that provides command signals to turn on the streetlamp when existing light levels fall below a predetermined threshold. The controller 304 may also be remotely programmable by command signals received by the RF receiver 306 via antenna 102 to accomplish other tasks.

Figure 4:
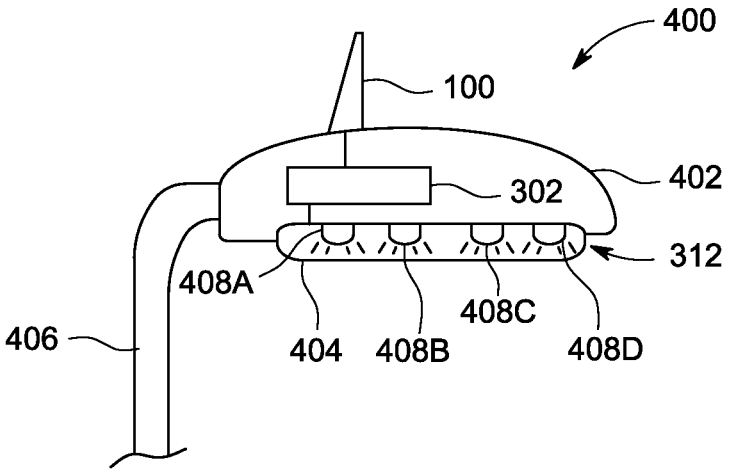
FIG. 4 is a partial cutaway side view of a street light head assembly according to an embodiment of the invention.

FIG. 4 is a partial cutaway side view of a street light head assembly 400 according to an embodiment. The street light head assembly 400 includes a housing 402 and a transparent dome 404 which are connected to a long support pole 406 (only partially shown) so as to be elevated from the ground. The transparent dome 404 surrounds and protects a plurality of LEDs 408A, 408B, 408C and 408D, and the housing 402 encases street lamp circuitry, such as the components for implementing the system 300 of FIG. 3. In some embodiments, the sensor antenna arrangement 100 may be of a modular construction, and may be configured to facilitate the physical connection to the housing 402 by using existing mounting hardware (not shown), and thus it may be retrofit to the top portion of the housing, for example, by removing an existing antenna. The antenna sensor arrangement 100 may include one or more types of sensors operable to monitor or detect external conditions and/or events such as, for example, the ambient light level, motion, sound, wind velocity and/or temperature. Thus, as shown, the antenna arrangement 100 is operably connected via coaxial cable 108 to the smart driver circuitry 302, which in turn is operably connected to the light source or lamp 312 consisting of the LEDs 408A-408D. Thus, in some embodiments, the sensor antenna arrangement 100 is connected to the street lamp via existing RF cabling and connectors. In some other embodiments, the sensor antenna arrangement 100 is integral to the overall street light head assembly 400.

Four LEDs 408A-408D are shown in FIG. 4 for ease of understanding, but it should be understood that, depending on the light output required, a particular street light may contain more or less LEDs and/or LED pairs. For example, pairs of LEDs may be arranged in rows, or in concentric circles, or in other configurations so long as their light outputs mix appropriately when the LEDs of a pair are active. In addition, each LED may be a separate packaged device (as shown in FIG. 4) which includes an LED chip surrounded by a resin dome. In some embodiments, pairs of LED chips may be packaged together as a single package.

Figure 5:
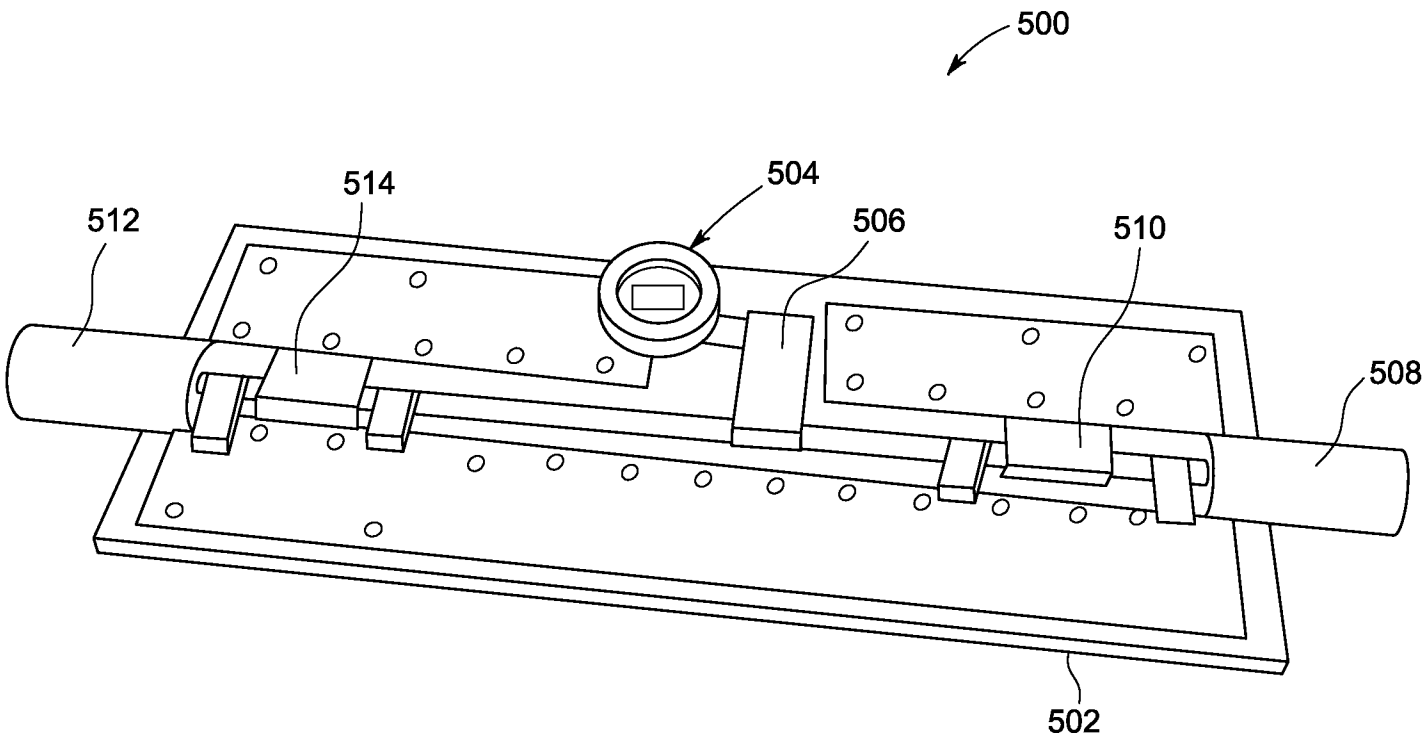
FIG. 5 illustrates an embodiment of a modular antenna sensor arrangement, not drawn to scale, according to an embodiment of the invention.

FIG. 5 illustrates an embodiment of a modular antenna sensor arrangement 500 that is not drawn to scale. The modular sensor includes a base 502 that supports a photodetector 504 which is connected to associated photodetector circuitry 506, a first connector 508 and associated output tuning circuitry 510, and a second connector 512 and associated input tuning circuitry 514. The base 502 may include mounting hardware (not shown) that is configured for easy attachment to existing mounting hardware available on an electronic device housing, for example, the lamp housing 402 shown in FIG. 4. In addition, the first connector 508 may be an SMA connector for easy attachment to the output of an antenna (not shown) and the second connector 512 may also be an SMA connector for easy attachment to an antenna input (not shown) of, for example, a smart driver circuit (not shown). The photodetector circuitry 504, the output tuning circuitry 510, and the input tuning circuitry 514 may be configured to be compatible with an antenna and smart driver circuitry associated with an electronic device, such as the street lamp described above with regard to FIGS. 3 and 4.

Thus, a sensor antenna arrangement as described herein operates by multiplexing the function of the existing radio-frequency (RF) cabling, connectors and mounting hardware, which eliminates the need for using any additional cabling connectors and mounting hardware. The reduction of interface cabling and connectors beneficially reduces the risk of introducing undesirable spectral transmissions into and out of the internal devices, while also significantly reducing procurement and installation expenses associated with having to use separate sensor connectors, cabling and mounting hardware. In addition, such a configuration permits sensor information to be communicated directly between the externally mounted sensors and the internal monitoring device circuitry.

An embodiment of a sensor antenna arrangement has been described herein in the context of retrofitting to a street lamp, but it should be understood that a sensor antenna arrangement according to the aspects disclosed herein could be used in conjunction with any type of device that receives RF signals via an antenna. For example, a sensor arrangement may be added to an automobile control circuit by retrofitting such a sensor arrangement between the car antenna and the automobile controller. In addition, although the sensor itself has been described above in the context of a photodetector for a street lamp, many other types of sensors could be utilized, either alone or in any combination. Examples of such sensors include, but are not limited to motion sensors, temperature sensors, wind speed sensors and audio sensors that could be utilized alone or in any combination.

The above description and/or the accompanying drawings are not meant to imply a fixed order or sequence of steps for any process referred to herein; rather any process may be performed in any order that is practicable, including but not limited to simultaneous performance of steps indicated as sequential.

Although the present invention has been described in connection with specific exemplary embodiments, it should be understood that various changes, substitutions, and alterations apparent to those skilled in the art can be made to the disclosed embodiments without departing from the spirit and scope of the invention as set forth in the appended claims.

What is claimed is:

1. A lamp, comprising:

a housing;

a light source;

a sensor antenna arrangement affixed to the housing and comprising an antenna connected to at least one sensor, wherein the at least one sensor monitors at least one external event and outputs at least one analog signal via a single coaxial cable, and wherein the antenna is operable to receive radio frequency (RF) signals and outputs the RF signals via the single coaxial cable; and driver circuitry supported within the housing and operably connected to the light source, the driver circuitry also operably connected to the sensor antenna arrangement via the single coaxial cable;

wherein the driver circuitry receives both the RF signals output by the antenna and the analog signals output by the at least one sensor via the single coaxial cable, separates and distinguishes the RF signals from the analog signals, and matches the separated signals to specific lamp operations to control functions of the light source.

2. The lamp of claim 1, wherein the sensor antenna arrangement further comprises a base configured to mount to mounting hardware located on the housing.

3. The lamp of claim 1, wherein the sensor antenna arrangement further comprises a connector coaxial cable connecting the antenna to the at least one sensor.

4. The lamp of claim 1, further comprising a sub-miniature version A (SMA) connector attached to the single coaxial cable, the SMA connector configured to mate with an RF cable input connector of the driver circuitry.

5. The lamp of claim 1, wherein the at least one sensor comprises a photodetector.

6. The lamp of claim 5, wherein the photodetector comprises a photodiode and an output tuning circuit, wherein the output tuning circuit is operably connected between the photodiode and the antenna.

7. The lamp of claim 5, wherein the photodetector comprises a photodiode and an input tuning circuit, wherein the input tuning circuit is operably connected between the photodiode and the driver circuitry.

8. The lamp of claim 1, wherein the driver circuitry comprises a power supply, an RF receiver, and a controller.

9. The lamp of claim 8, wherein the controller utilizes an asynchronous time division (ATD) multiplexing protocol to separate and isolate RF signals from analog signals.

10. The lamp of claim 1, wherein the light source comprises at least one light emitting diode (LED).

11. The lamp of claim 1, wherein the at least one sensor comprises at least one of a photodetector, a motion sensor, a temperature sensor, a wind speed sensor and an audio sensor.

* * * * *